US008245864B2

(12) United States Patent
Garland

(10) Patent No.: US 8,245,864 B2
(45) Date of Patent: Aug. 21, 2012

(54) DIAPER PAIL

(76) Inventor: Thomas A. Garland, Bradenton, FL (US)

( * ) Notice: Subject to any disclaimer, the term of this patent is extended or adjusted under 35 U.S.C. 154(b) by 463 days.

(21) Appl. No.: 12/471,505

(22) Filed: May 26, 2009

(65) Prior Publication Data

US 2010/0301050 A1 Dec. 2, 2010

(51) Int. Cl.
*B65D 25/28* (2006.01)
*B65D 25/14* (2006.01)

(52) U.S. Cl. ..... 220/252; 220/212.5; 220/495.05; 220/495.06; 220/495.08; 220/908; 220/908.1

(58) Field of Classification Search ..... 220/212.5, 220/252, 262, 263, 495.05, 495.06, 495.08, 220/908, 908.1
See application file for complete search history.

(56) References Cited

U.S. PATENT DOCUMENTS

| | | | | |
|---|---|---|---|---|
| 1,238,010 | A | 8/1917 | Fisher | |
| 1,333,051 | A | 3/1920 | Young | |
| 1,638,360 | A | 8/1927 | Olson | |
| 4,736,860 | A | 4/1988 | Bemis | |
| 4,779,728 | A | 10/1988 | Hanifl et al. | |
| 4,869,049 | A | 9/1989 | Richards et al. | |
| 4,890,733 | A | 1/1990 | Anderson | |
| 5,046,614 | A | 9/1991 | Torres et al. | |
| 5,147,055 | A | 9/1992 | Samson et al. | |
| 5,651,231 | A | 7/1997 | Garland | |
| 5,765,339 | A | 6/1998 | Garland | |
| 2007/0125792 | A1 | 6/2007 | Pollack et al. | |
| 2008/0221544 | A1 * | 9/2008 | Dommerholt | 604/385.13 |
| 2010/0187235 | A1 * | 7/2010 | Chen | 220/495.06 |

* cited by examiner

*Primary Examiner* — Anthony Stashick
*Assistant Examiner* — Madison L Wright
(74) *Attorney, Agent, or Firm* — Barlow, Josephs & Holmes, Ltd.

(57) ABSTRACT

A diaper pail includes a pail, an upper enclosure having a substantially smooth and continuous outer surface, and a drum assembly mounted within the upper enclosure for transferring a soiled diaper into a disposal bag while minimizing the release of odor from previously disposed diapers already within the disposal bag. The outer surface of the upper enclosure and drum cooperate to form a smooth continuous outer surface which is easily cleaned. The drum assembly includes a flexible plastic seal received around an opening in the lower portion of the drum housing. A deck portion of the seal engages an outer surface of the drum, with the free edge of the flexible seal being movable relative to fixed edge to conform to irregularities in the outer surface of the drum. An actuator handle actuates movement of the drum.

4 Claims, 16 Drawing Sheets

DIAPER PAIL

BACKGROUND AND SUMMARY OF THE INVENTION

The instant invention relates to waste containers for diapers and more particularly to diaper pails intended to minimize odor associated with the use of such diaper pails and the temporary storage of diapers within such diaper pails.

Diaper pails for disposing of soiled diapers are known in the art. A conventional diaper pail typically includes a pail portion which holds a disposal bag, and a receptacle assembly mounted on top of the pail configured to receive the soiled diaper and transfer the soiled diaper into the disposal bag while minimizing the release of odor from previously disposed diapers already within the disposal bag.

Various receptacle assemblies within the prior art have included rotating drums contained within a housing having an opening communicating with the internal disposal bag. The drum has an opening to receive the soiled diaper. To dispose of the diaper, the drum is rotated to align the drum opening with the top opening in the housing. Once the diaper is received into the opening in the drum, the drum is rotated to align the drum opening with the lower opening and allow the diaper to drop into the disposal bag. For example, the inventor's prior U.S. Pat. Nos. 5,651,231 and 5,765,339 disclose such a diaper pail including a rotating drum with a piston valve for moving the diaper into the disposal bag. US Patent Publication No. 20070125792 to Pollack et al also discloses a somewhat similar diaper pail including a rotating drum, which is actuated by an electromechanical drive system.

While these types of diaper pails have had relatively good commercial success, it has been found that the existing designs still have drawbacks that could be improved upon. For example, it has been found that the existing designs still do not effectively prevent the escape of odors. Providing a seal around the housing and between the upper receptacle assembly and the lower pail is not a difficult task, as these components do not move relative to each other during normal use and the seals are loaded only in compression, but, this arrangement does require multiple seals and additional related parts as well as additional cost and complexity. On the other hand, the provision of a substantially airtight seal between moving components is not as simple, and the most difficult place to provide a seal is between the moving surfaces of the drum and the lower half of the drum housing. The inventor's '231 and '339 patents attempted to provide a seal by securing a foam sheet between the surfaces of the drum and the inner shroud and/or a ring seal surrounding the lower opening into the pail. However, in practice, foam sheets and other ring seals have not been ideal. One issue is that the hook and loop tabs on diapers are prone to catch on the edges of the seal or on the face of the seal itself, and become lodged between the drum and the housing. In such an event, where two surface are moving relative to each other but are constrained to a constant separation, a great deal of compressive and shear force is generated between the rotating and fixed surfaces often destroying the foam or other soft seal. Another issue is that the sheet foam seals are expensive to manufacture and required the use of soft foam with a top fabric layer to reduce friction. Stamping these seals from roll stock created a great deal of waste. Further, the foam seals have to be properly positioned and glued in place, or carefully positioned in place, requiring skilled labor. O-ring seals also are not ideal. They are hard to hold in place and are easily displaced during use. If the O-ring is too hard, the seal does not properly conform to the surface irregularities between the drum and the housing. If the O-ring is soft enough to conform to the drum surface, then the coefficient of friction is too high and the drum is hard to turn.

In contrast, Pollack '792 does not include any type of seal between the drum and the housing, and the escape of odor is instead handled by providing seals, which are not in contact with the rotating surface, but rather are positioned both above and below the rotating drum, and further by including a charcoal filter or other scent emitting devices to mask the escaping odors. Odor eliminating devices need to be replaced frequently, replacements are not always kept in the house, and are costly, driving up the ongoing costs of use of the device. Pollack also relies on an electro-mechanical system to sense the presence of a diaper in the drum and to turn the drum. Any type of mechanical system such as this is prone to mechanical failure and/or wear over time. Another drawback to an electro-mechanical system is the reliance on electricity, the use, replacement and cost of batteries, or that the pail must be located near an outlet to function.

Another example of a shortcoming in the prior art is the prior art devices fail to provide a receptacle assembly which is easily used and cleaned. Known diaper pails typically use a receptacle assembly mounted on top of a pail configured to receive the soiled diaper and transfer the soiled diaper into the disposal bag. These diaper pails typically use a bag located within the pail to receive the diapers. Naturally, the use of a bag within the diaper pail is one means of preventing the escape of odors. However, these known diaper pails contain excessive gaps and holes, particularly in the receptacle assembly and related to providing a door and seal at the top of such assembly, and further related to providing a door and seal at the top. The '792 publication to Pollack et al, for example, shows a door over the entry point and various holes and slots immediately adjacent to the location where the diapers are inserted, and insofar as the door is normally closed, it is not possible to easily inspect surface which are most likely to become soiled. The Inventor's prior US patents show a product with a substantially exposed rotating drum having a long perimeter clearance slot all the way around the drum and in the top surface of the receptacle assembly. To the extent such products have any more holes, gaps, and slots that are necessary, such products are less able to contain odors and are also harder to keep clean as there is no single smooth, continuous and easily inspected and cleaned surface adjacent the location where the diapers are inserted. Additionally, known diaper pails often have doors, protruding rotating drums, and similar mechanical looking components which make it difficult to achieve an attractive and suitably shaped product for use in a nursery.

Accordingly, there is believed to be a need in the industry for an improved diaper pail, which includes a better seal arrangement between the housing and the drum to further reduce the escape of odors from within the pail during the rotation of the drum from the upper position to the lower position. Additionally, there is believed to be a need in the industry for an improved diaper pail which provides a minimum number of holes and gaps in the outer surface which can allow odors to escape from the diaper pail. Also, there is believed to be a need in the industry for an improved diaper pail, which has a substantially smooth and continuous, easily cleaned, outer surface adjacent to where the soiled diaper is inserted. Finally, there is believed to be a need for an improved diaper pail which provides a receptacle assembly which is free of doors, protruding rotating drums, and similar mechanical looking components which make the diaper pail look mechanical and thus less suitable for use in a child's nursery.

The instant invention provides a solution to these problems with a diaper pail having a substantially smooth and continuous upper wall which surrounds the diaper opening and which encloses the entire drum assembly, and further having an improved plastic annular seal that has a sufficiently high durometer to provide low friction and less likelihood that diapers' fasteners will catch between the drum and housing yet provides sufficient flexibility to form a functional seal.

As will be further described, the diaper pail generally includes a pail, a bagholder frame received over an open top of the pail, an upper enclosure, and a drum assembly rotatably mounted within the upper enclosure for receiving and transferring a soiled diaper into a disposal bag within the pail while minimizing the release of odor from previously disposed diapers already within the disposal bag.

The pail is generally oval in shape having a closed bottom wall, upwardly extending sidewalls and an open top.

Rotatably hinged to the rear wall of the pail is a bagholder frame which is rotatably movable from a closed position over the open top to an open position where the interior of the pail is accessible. The bagholder frame has a central circular opening through which a plastic disposal bag is received and supported.

Also rotatably hinged to the rear wall of the pail is the upper enclosure. The upper enclosure and the bagholder frame share the same hinge axis. The upper enclosure is rotatably movable from a closed position over the open top of the pail to an open position where the interior of the pail is accessible. The front portions of the bagholder frame and upper enclosure also share a latching assembly for releasably holding the components in the closed positions. The latching assembly also allows the bagholder frame to be releasably attached to the upper enclosure when these components are both in the open position.

The upper enclosure has an upper wall having a substantially smooth and continuous outer surface with a central opening, sized to allow a diaper to pass through. Preferably, the opening is aligned along an axis that is angled from vertical toward the front of the assembly. In particular, the area immediately surrounding the diaper opening is smooth and continuous facilitating the inspection and cleaning of those surfaces most likely to be soiled during the process of inserting a diaper into the pail. The upper enclosure also includes a hinge point which is inside the perimeter of the pail further eliminating holes and gaps associated with hinge assemblies that could allow the escape of odors.

The drum assembly generally includes a drum housing having an upper opening in an upper portion thereof in communication with the opening in the upper wall of the upper enclosure, and a lower opening in a lower portion thereof configured and arranged for mated alignment with a central opening in the bagholder frame. In this regard, the lower portion includes a downwardly projecting neck surrounding the lower opening. As the upper enclosure is rotated to the closed position over the bagholder frame, the neck is received into the central opening to capture and hold the disposal bag in place. An important aspect of the invention is that the entire drum enclosure is contained within the inside of the upper enclosure and beneath the upper wall so that the outer surface of the enclosure can remain substantially smooth and continuous, providing an aesthetically attractive appearance while also eliminating unnecessary holes and gaps.

A substantially spherical drum is rotatably mounted within the drum housing for rotation about a substantially horizontal axis. The drum has a substantially spherical outer surface and a cylindrical diaper cavity arranged along a longitudinal axis perpendicular to the axis of rotation of the drum. The drum is rotatably movable within the drum housing between a normally closed position wherein the cavity faces downwardly and is aligned with the opening in the lower portion of the drum housing and an open position wherein the cavity faces upwardly and is aligned with the opening in the upper portion of the drum housing. In the closed position, the spherical surface of the drum sits within the opening in the upper enclosure and closes off the opening. The smooth spherical surface of the drum blends with the smooth surface of the upper enclosure to form a substantially smooth and continuous outer surface. In the open position, a diaper can be deposited into the cavity through the opening in the upper enclosure. Upon rotation of the drum to the closed position, the cavity returns to alignment with the lower opening, the diaper falls by means of gravity through the lower opening, through the central opening of the bagholder frame and is deposited into the disposal bag.

The drum assembly further includes a flexible plastic annular seal received around the inner peripheral edge of the circular opening in the lower portion of the drum housing. The flexible seal includes a vertically extending skirt portion anchored to the lower portion of the drum housing and a deck portion having an outer fixed edge connected to an upper edge of the skirt portion. In the preferred embodiment, the deck portion extends radially inwardly and downwardly from the upper edge of the skirt portion terminating in a lower edge which is free to move downward. The lower edge of the deck is attached to a downward projecting inner skirt. The lower portion of the inner skirt includes hooked tabs to prevent the skirt and deck portion from moving upward. A lower portion of the downwardly angled deck portion of the seal engages the outer surface of the drum adjacent the lower opening, while the free edge of the flexible seal is movable relative to the fixed end to conform to irregularities in the outer surface of the drum. The deck portion of the seal is also provided with a slight upwardly convex curve to provide a limited but conformable smooth surface contact and seal with the drum. The above-described flexible seal forms a relatively airtight seal around the peripheral edges of the rotating drum to substantially maintain foul air within the disposal bag. While a perfect seal will never be possible, the above-described seal configuration provides improved balance between a sufficiently rigid material, which will provide a low level of friction, a flexible conforming design, which provides a sufficiently stable seal, and a smooth shape and hard surface to prevent hook and loop fasteners from becoming attached to, or destroying the seal.

An actuator handle actuates movement of the drum between the closed and open positions. To facilitate use of the pail, the handle is only required to be moved through 150 degrees of rotation.

Accordingly, among the objects of the instant invention are: the provision of diaper pail including an improved seal which reduces escaping odors; the provision of a diaper pail including a harder plastic seal which, in combination with its smooth shape, will reduce occurrences of diapers becoming lodged between the drum and the housing or occurrences of the hook and loop fastener tabs becoming attached to the seal and resulting in damage to the seal; the provision of a harder plastic seal which provides a low coefficient of friction for ease of rotation of the drum; the provision of a diaper pail which has a minimum of holes and gaps which can allow the unwanted escape of odors; the provision of a diaper pail which has a continuous, smooth, and easily inspected and cleaned surface adjacent the point where diapers are inserted into the product; the provision of a diaper pail which is simple in construction and low in cost; the provision of a diaper pail which is aesthetically attractive to the eye and free of unattractive and mechanical looking appearance of doors rotating drums and similar components; the provision of a diaper pail which has an opening angled toward the front to facilitate placement of the diaper into the drum; and the provision of a diaper pail which requires only a minimum rotation of the handle to move the drum between the operable positions.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
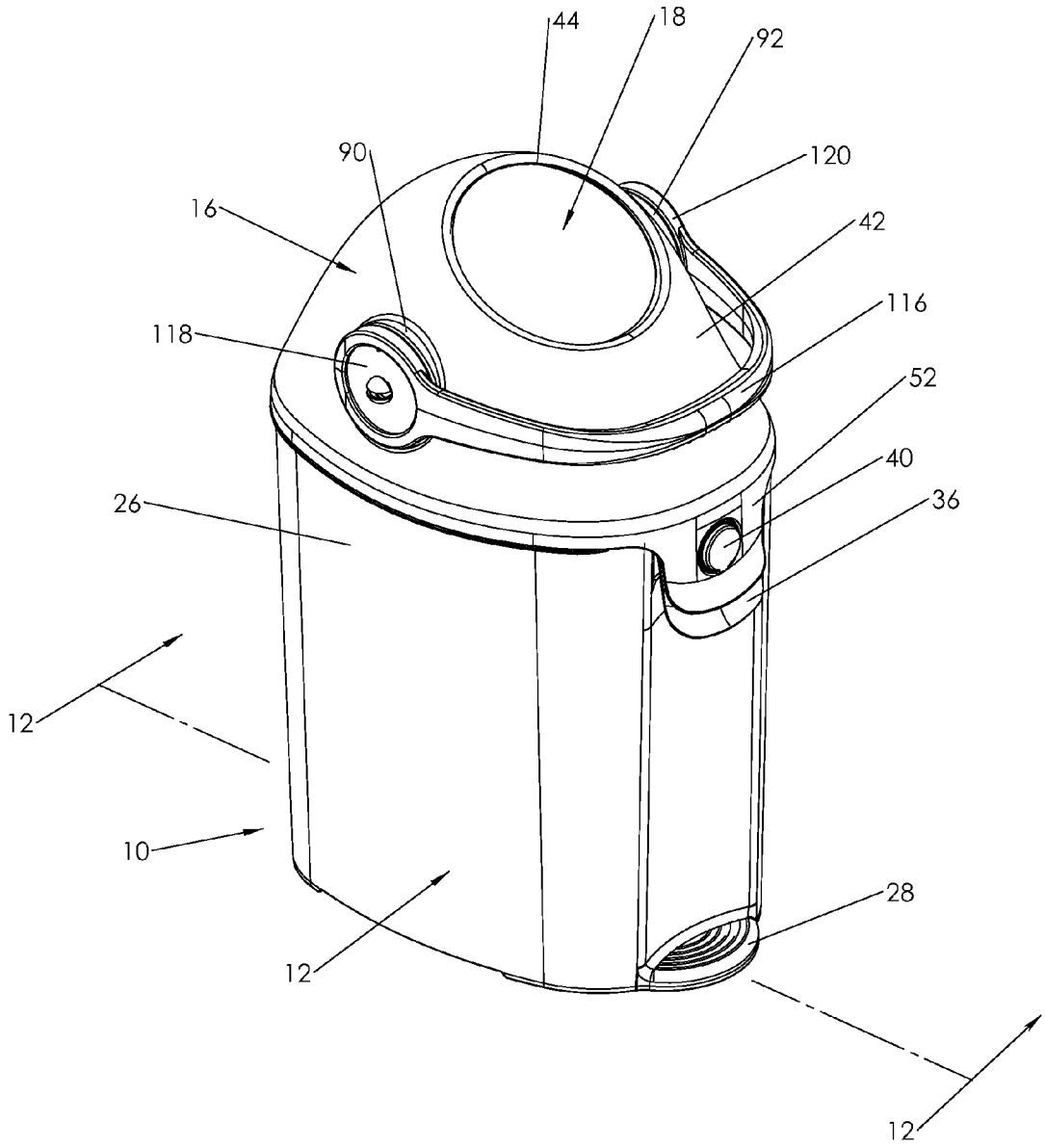
FIG. 1 is a perspective view of the diaper pail of the present invention.
Figure 1A:
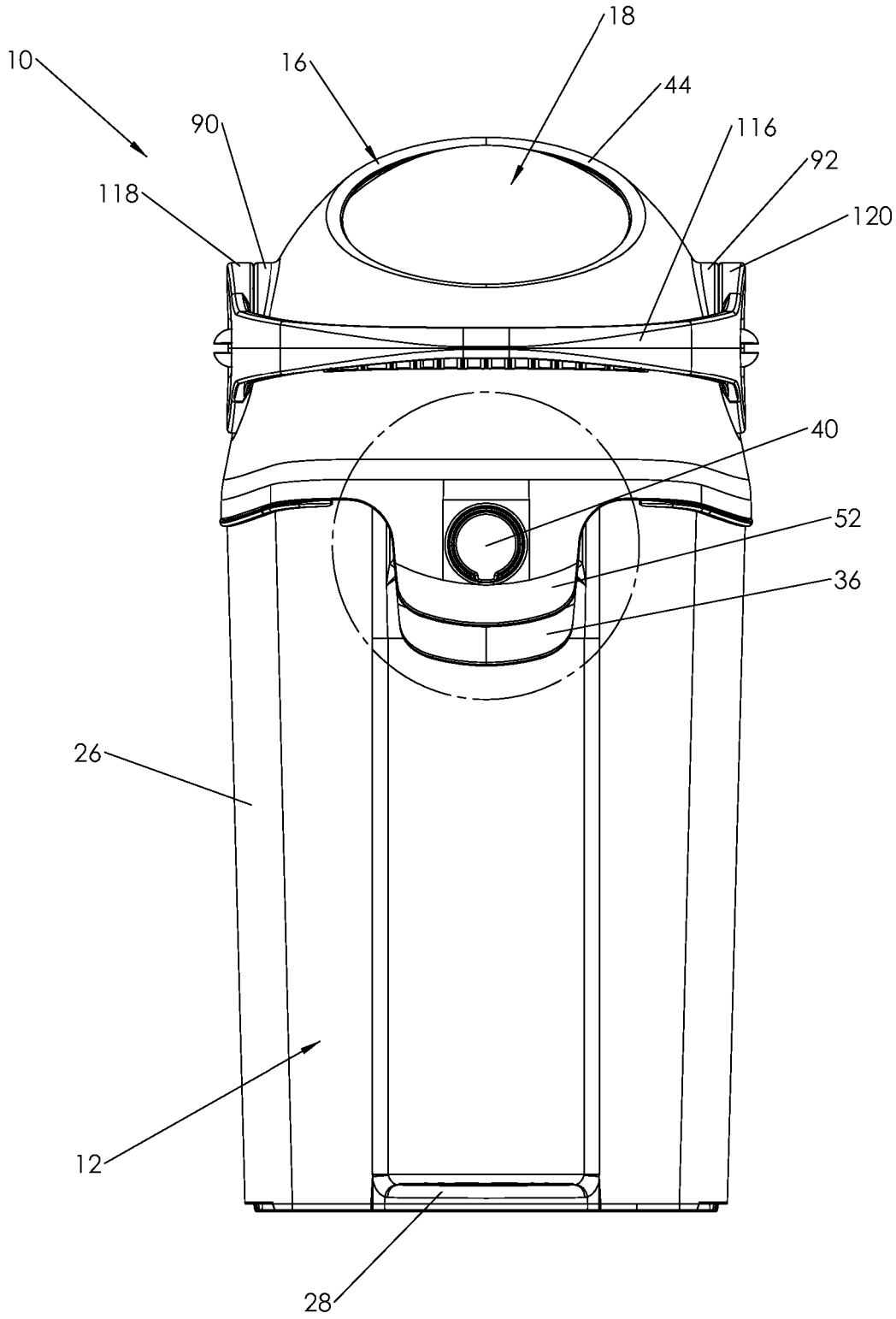
FIG. 1A is a front view thereof.

Referring now to the drawings, the diaper pail of the instant invention is illustrated and generally indicated at 10 in FIGS. 1-12. As will hereinafter be more fully described, the instant invention provides solutions to the problems identified hereinabove with a diaper pail 10 having a substantially smooth and continuous outer surface surrounding the diaper opening and enclosing the entire drum assembly and further having an improved seal arrangement between a drum housing and a rotating drum to reduce the escape of odors from within the pail during the rotation of the drum from an upper position to a lower position. The substantially smooth and continuous outer surface provides a minimum number of holes and gaps in the outer surface which can allow odors to escape from the pail while also providing an easily inspected and cleaned outer surface adjacent to where the diaper is inserted. The improved seal arrangement includes an annular seal having a sufficiently high durometer that provides a low coefficient of friction between the drum and drum housing yet also provides sufficient flexibility to form a functional seal. The plastic seal has a smooth shape advantageously configured to provide a smooth transition to the adjacent drum housing and a minimal but smooth contact surface that can easily confirm to the shape and any surface irregularity of the drum. While the invention calls for a plastic material with a sufficiently high durometer for a particular purpose, the term "sufficiently high" is relative and open to interpretation. There is a wide range of durometers and types of plastics that fill the needs as described. Most importantly, the plastic must be injection moldable such that the plastic seal can be formed by inexpensive molding processes. The primary significance is that the material is not a soft foam or soft rubber material having a low durometer and a high coefficient of friction.

As will be described in detail below, the diaper pail 10 generally includes a pail assembly 12, a bagholder frame generally indicated at 14 and received over an open top of the pail assembly, an upper enclosure generally indicated at 16, and a drum assembly generally indicated at 18 rotatably mounted within the upper enclosure 16 for receiving and transferring a soiled diaper 20 into a disposal bag 22 (see FIG. 12) within the pail assembly 12 without the substantial release of odor from previously disposed soiled diapers 20 already within the disposal bag 22.

The pail 12 is generally oval in shape having a closed bottom wall 24, upwardly extending sidewalls 26 and an open top. A foot 28 is provided at the bottom front of the pail 12 so that the user may step on the foot 28 to stabilize the pail 12 and prevent tipping during use. The pail 12 is sized to accommodate a conventional kitchen sized disposal bag 22 which is suspended within the pail 12.

Figure 3:
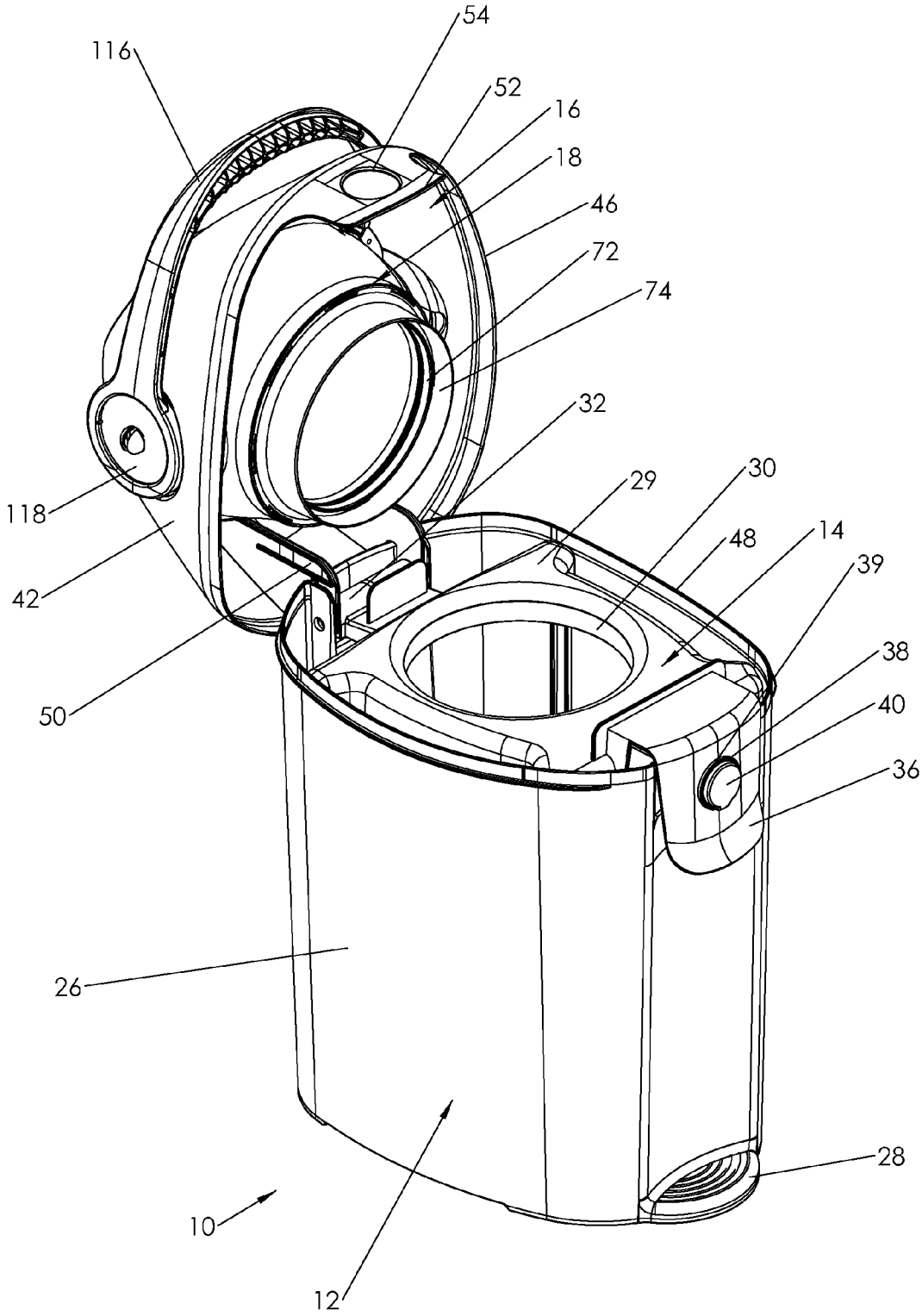
FIG. 3 is yet another perspective view thereof showing the upper enclosure rotated to the up position.
Figure 3A:
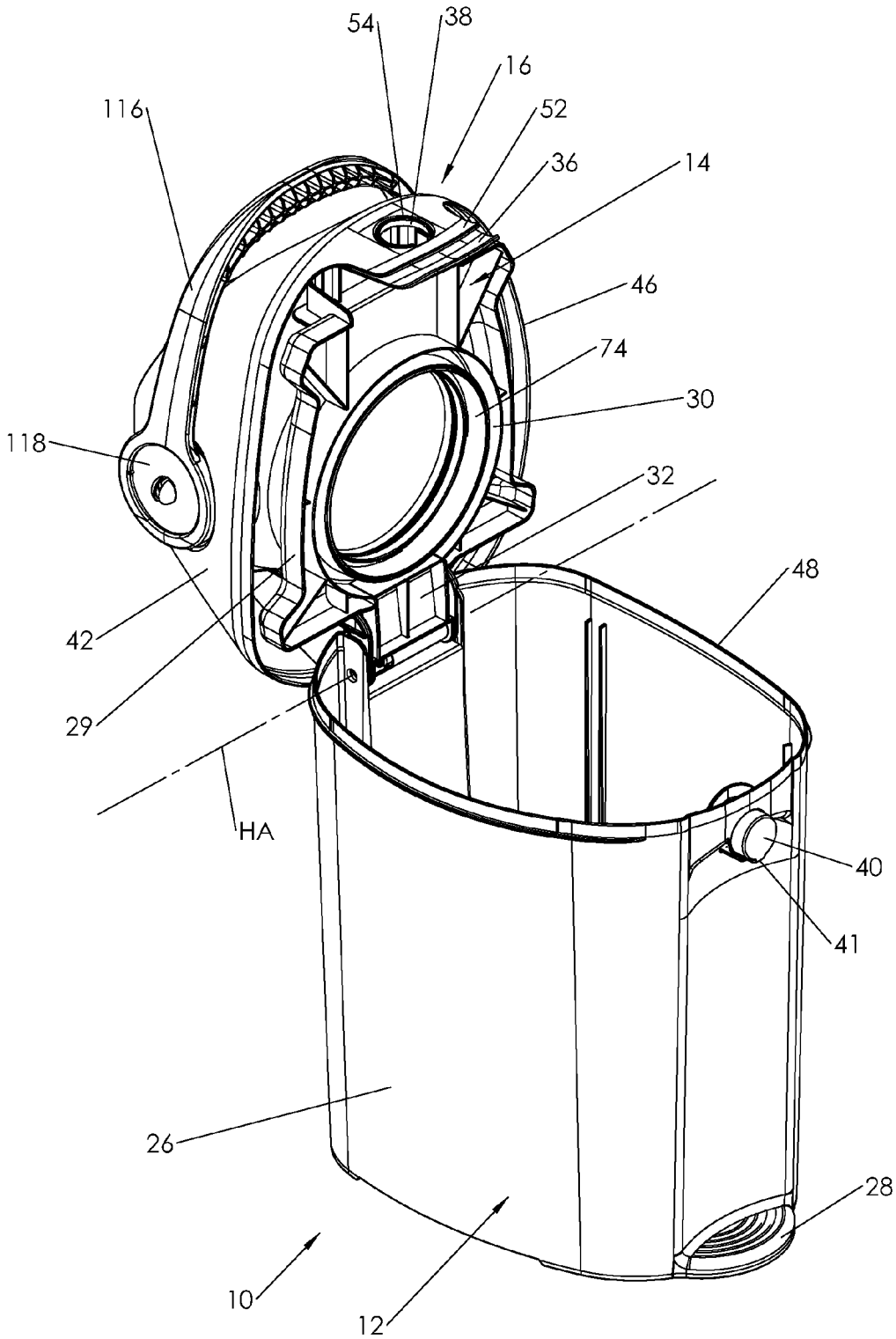
FIG. 3A is still another perspective view thereof showing the upper enclosure and bagholder frame secured together and rotated to the up position.
Figure 4:
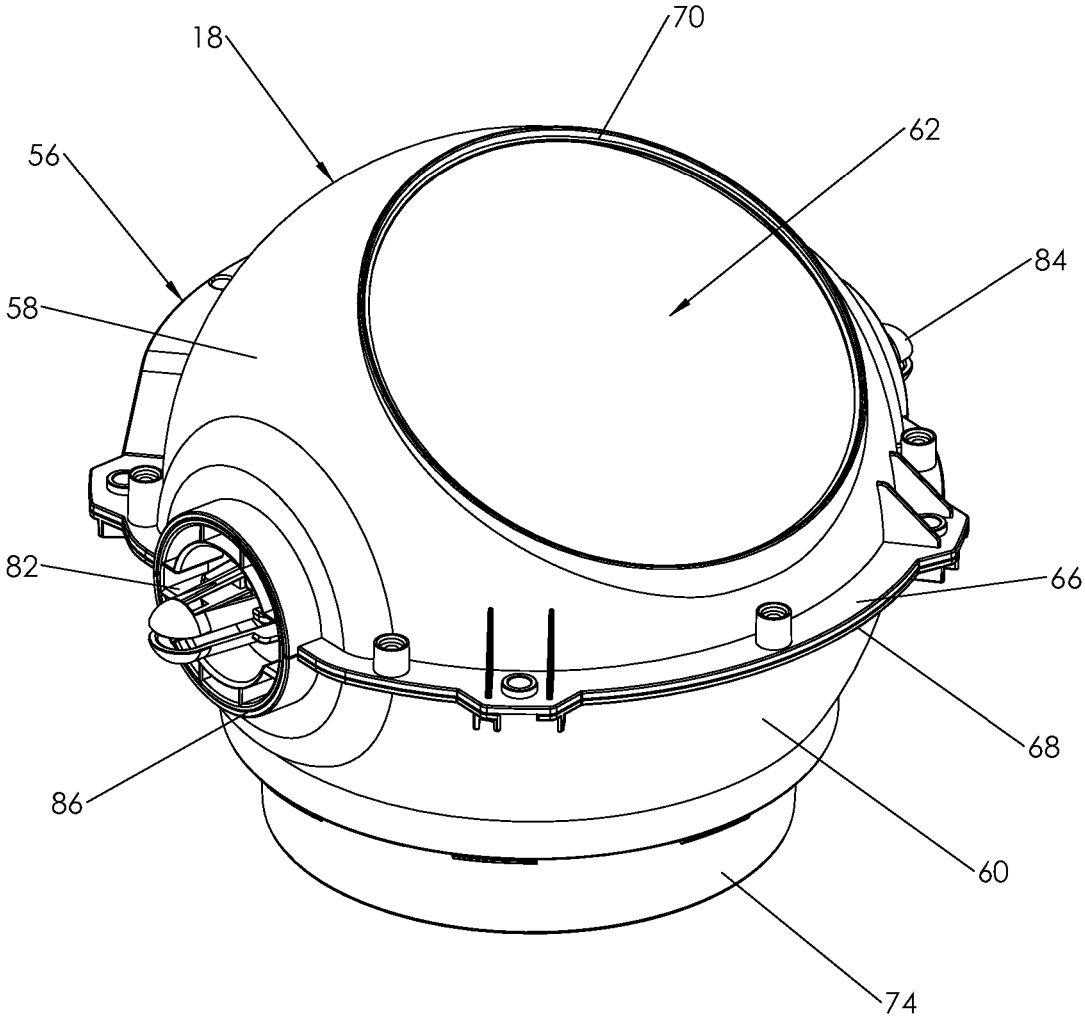
FIG. 4 is perspective view of the drum assembly of the present invention.
Figure 5:
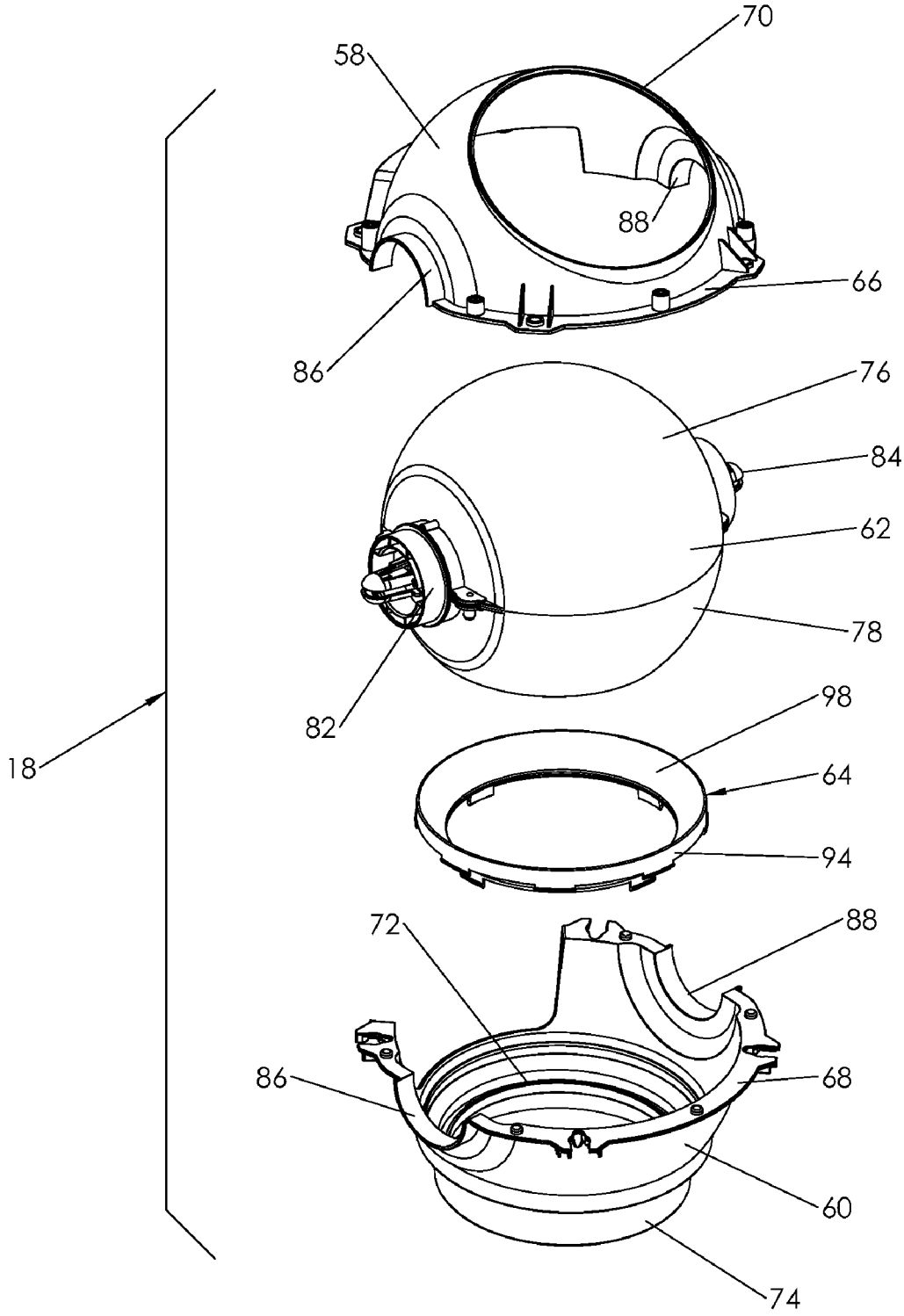
FIG. 5 is an exploded perspective view of the drum assembly.
Figure 6:
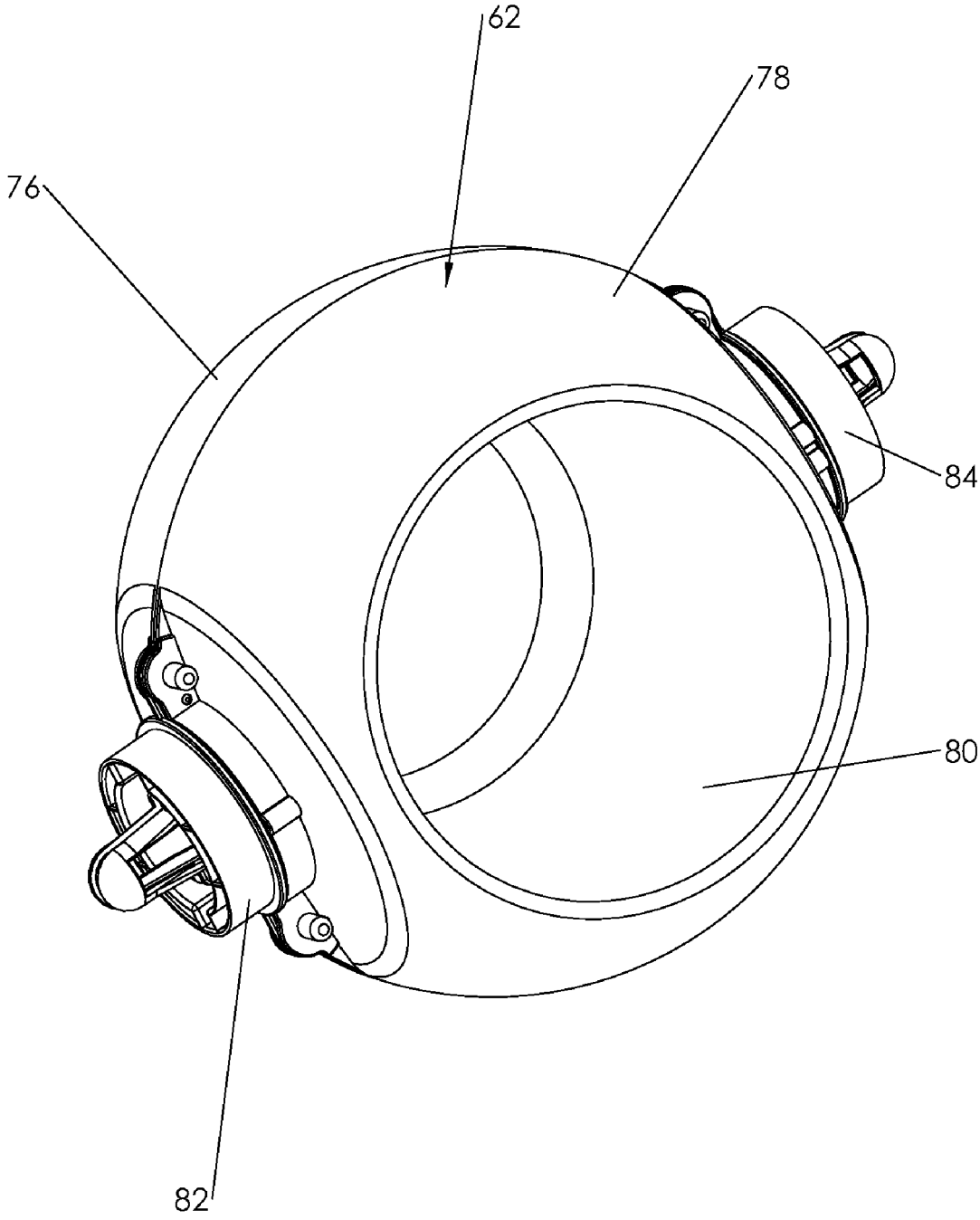
FIG. 6 is a perspective view of the drum rotated to show the cylindrical cavity.

Rotatably hinged to the rear wall of the pail 12 is the bagholder frame 14 (see FIGS. 3 and 3A) which is rotatbly movable from a closed position over the open top (as shown in FIG. 3) to an open position (as shown in FIG. 3A) where the interior of the pail 12 is accessible. Rotation of the frame 14 to the upper position will be required to remove a full bag of diapers from within the pail 12. The bagholder frame 14 has a generally square body portion 28 with a central circular opening 30 through which the plastic disposal bag 22 is received. As noted above, the rear edge of the body 28 of the frame 14 includes a hinge body 32 that is rotatably mounted to a mating hinge 34 supported on the inner side of the rear portion of sidewall 26 of the pail 12. The front edge of the frame 14 includes a flexible tab 36 which extends downwardly over the front portion of the sidewall 26 of the pail 12. The tab 36 includes a small circular opening 38, which is received over a circular spring loaded button 40 housed within the front portion of sidewall 26 of the pail 12 (see FIGS. 1 and 12). The button 40 is selectively depressed to allow the tab 36 to be released and the frame 14 to be pivoted upwardly to remove a full bag 22 from the pail 12. When returned to the closed position, the tab 36 slides over the button 40 until the button 40 seats itself within the circular opening 38.

Figure 1B:
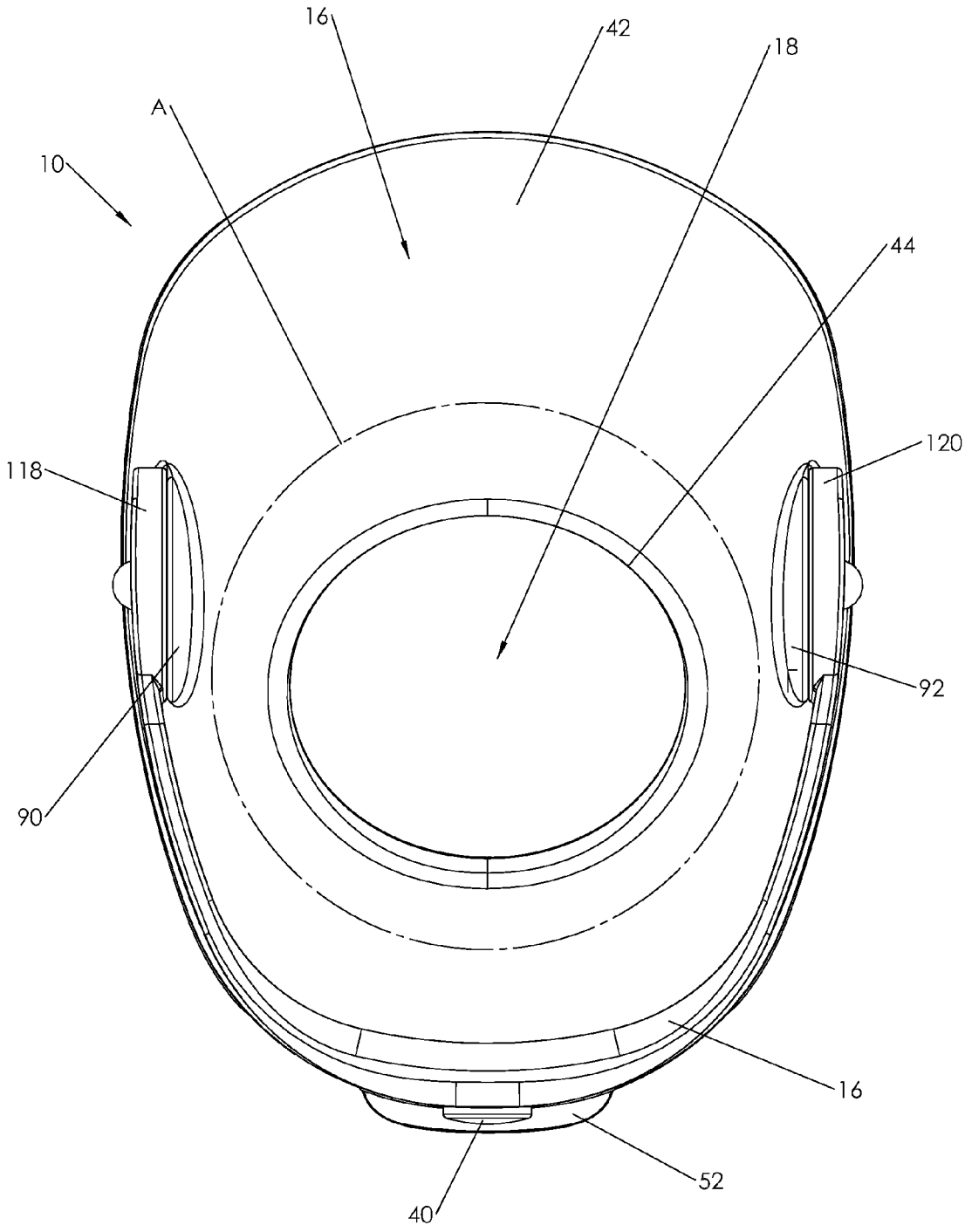
FIG. 1B is a top view thereof.
Figure 2:
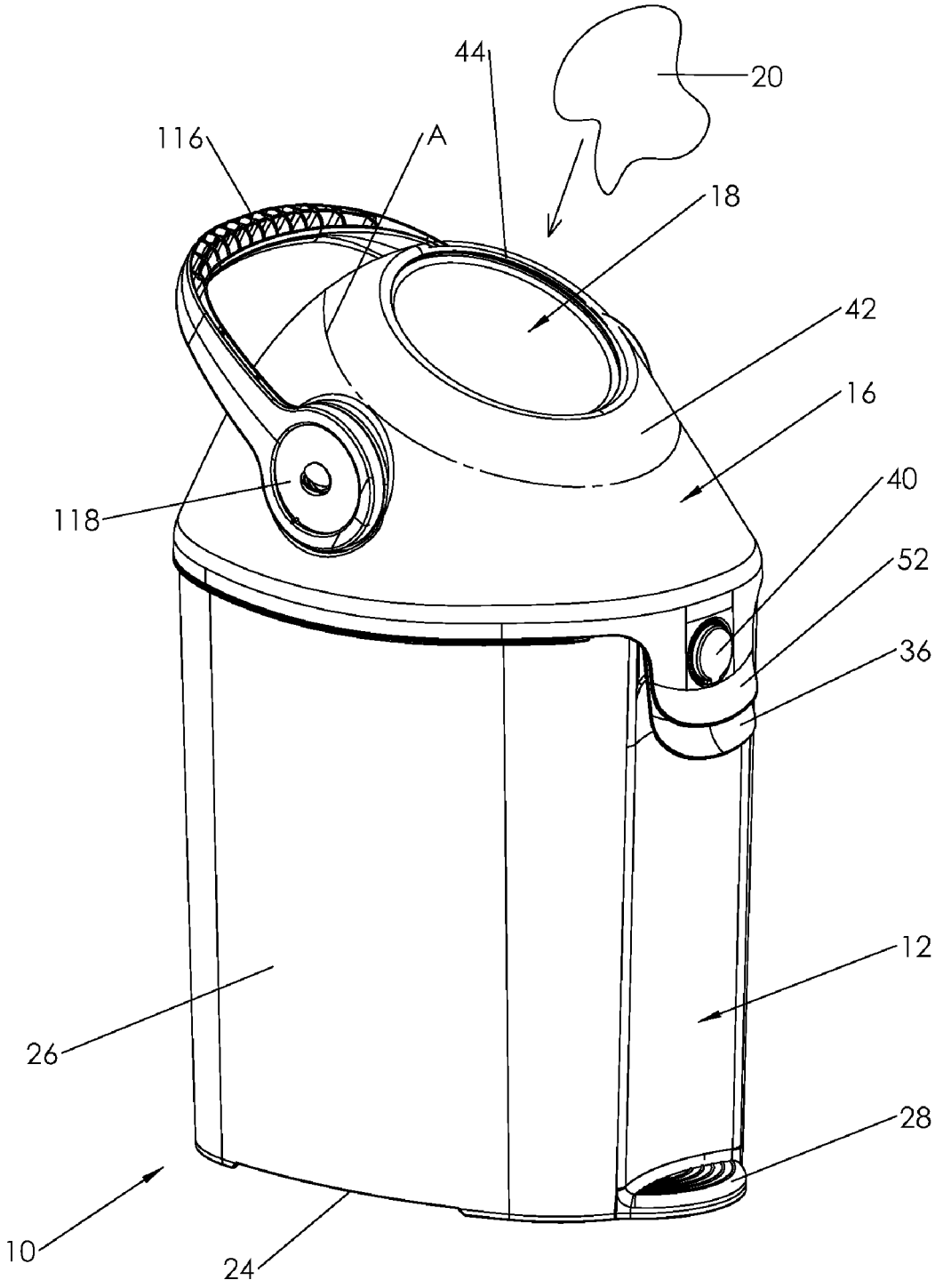
FIG. 2 is another perspective view thereof showing the handle rotated to the open position.

Still referring to FIGS. 1-3, there is also shown the upper enclosure 16. The upper enclosure 16 has an upper wall 42 having a circular opening 44 sized to allow a diaper 20 to pass through. As best shown in FIGS. 1, 1A, 1B, 2 and 12, the opening 44 is preferably aligned along an axis OA that is angled from a vertical axis VA toward the front of the assembly. The angled orientation of the upper opening 44 facilitates depositing of a diaper 20 into the opening 44 during use. The lower peripheral edge 46 of the upper wall 42 is shaped so as to interfit with the upper peripheral edge 48 of the sidewalls 26 of the pail and close off the interior of the pail 12 (See FIG.

3). Similar to the bagholder frame 14, the rear edge of the upper wall 42 of the upper enclosure 16 includes a hinge body 50 is rotatably hinged to the rear wall of the pail 12. In fact, it is preferred that the upper enclosure 16 and the bagholder frame 14 share the same hinge axis HA (See FIGS. 3A and 12). The upper enclosure 16 is rotatably movable from a closed position over the open top of the pail (see FIGS. 1 and 2) to an open position (See FIGS. 3 and 3A) where the interior of the pail 12 is accessible. The front edge of the upper enclosure 16 also includes a flexible tab 52 including a circular opening 54, which is received over the spring loaded button 40 in the front wall of the pail 12. The spring loaded button 40 thus releasably holds both the frame 14 and the upper enclosure 16 in the closed positions.

Referring to FIGS. 1B and 2, it is pointed out that the upper wall 42 of the enclosure 16 is provided with a substantially smooth and continuous outer surface over substantially all of the enclosure structure. This design feature takes into consideration the practical realities of attempting to place soiled diaper into the pail 10 in actual use. The user is typically preoccupied with attending to the baby, and may not be able to provide sufficient attention to the act of carefully inserting the diaper into the opening 44. It is highly probably and likely that the soiled diaper will contact the outer surface of the enclosure 16 during use of the pail 10. It is therefore an important consideration to provide the ability to easily inspect and clean this area for proper maintenance and use of the pail 10. As indicated above, the substantially smooth and continuous outer surface provides a minimum number of holes and gaps in the outer surface which can allow odors to escape from the pail while also providing an easily inspected and cleaned outer surface in an area adjacent to where the diaper is inserted. In particular, referring to FIG. 1B, an area A (shown in dotted lines), immediately surrounding the opening 44 is shown to be free of any structures, gaps, holes, protrusions, ridges etc, which would interfere with cleaning of this area which is the most likely area to be soiled when inserting a diaper into the opening 44. Generally, this area A measures about 2 inches beyond the perimeter of the opening 44, although there is no hard and fast dimension that is required.

Figure 1C:
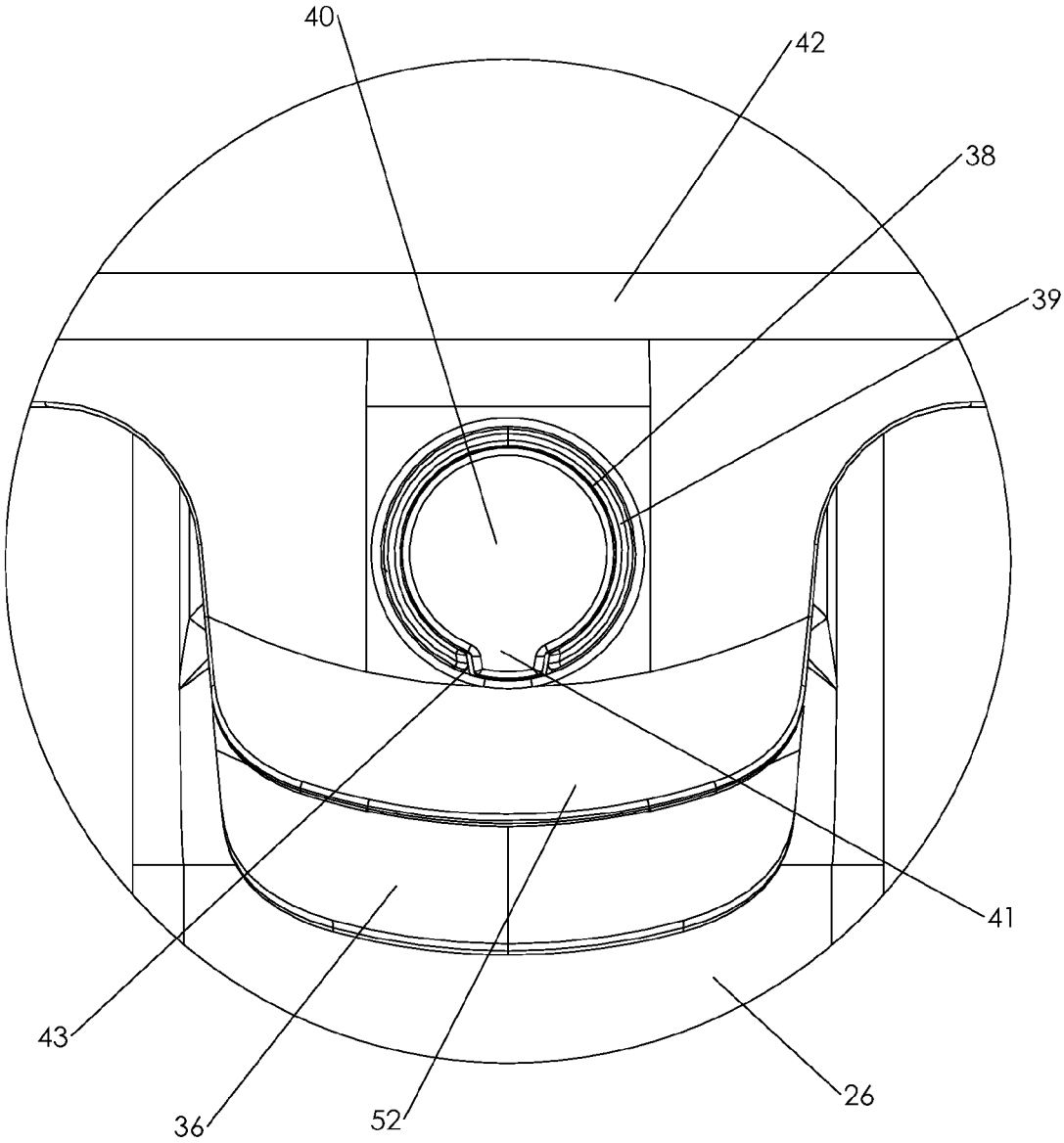
FIG. 1C is an enlarged view of the latching area encircled in FIG. 1A.

As best shown in FIGS. 1C, 3 and 3A, the bagholder frame tab 36, the button 40 and the upper enclosure tab 52 are configured so that the bagholder frame 14 and upper enclosure 16 can remain secured together when moved to the upper position (FIG. 3A). Referring to FIGS. 1C and 3, it can be seen that the tab 36 includes a raised annular shoulder 39 partially encircling the opening 38, which is now seen as including a notch 43 (see also FIG. 10). The annular shoulder 39 is configured and arranged to fit within the circular opening 54 of the tab 52 so that the two tabs 36 and 52 interlock in either the open or closed positions. To provide stable locking and positioning of all of the features of the latching mechanism, the, button 40 is provided with a squared detent 41 which interlocks in the notch 43. The notch 43 in the tab 36 allows the lower edge opening 54 of the tab of the upper enclosure to directly contact the button 40 at the lower edge. The annular shoulder 39 on the bagholder tab 36 provides a snap release attachment of the bagholder frame 14 to the upper enclosure 16 when the bagholder frame 14 is in the open position by simply snapping the tab 52 over the annular should 39. However, it is not desirable to have this snap release function available when the upper enclosure 16 is in the closed position. In this regard, the area where the shoulder 39 is removed allows the lower edge of the opening 54 to contact the bottom portion 41 of the button 40 at a point further from the front end of the button, thereby better securing the upper enclosure 16 to the pail 12 until the button is pushed to allow the components to be released.

Turning now to FIGS. 4-10, the drum assembly 18 generally includes a two-piece drum housing 56 having an upper drum housing portion 58 and a lower drum housing portion 60, a two-piece spherical drum 62 and a flexible annular seal 64 constructed in accordance with the teachings of the present invention.

Figure 12:
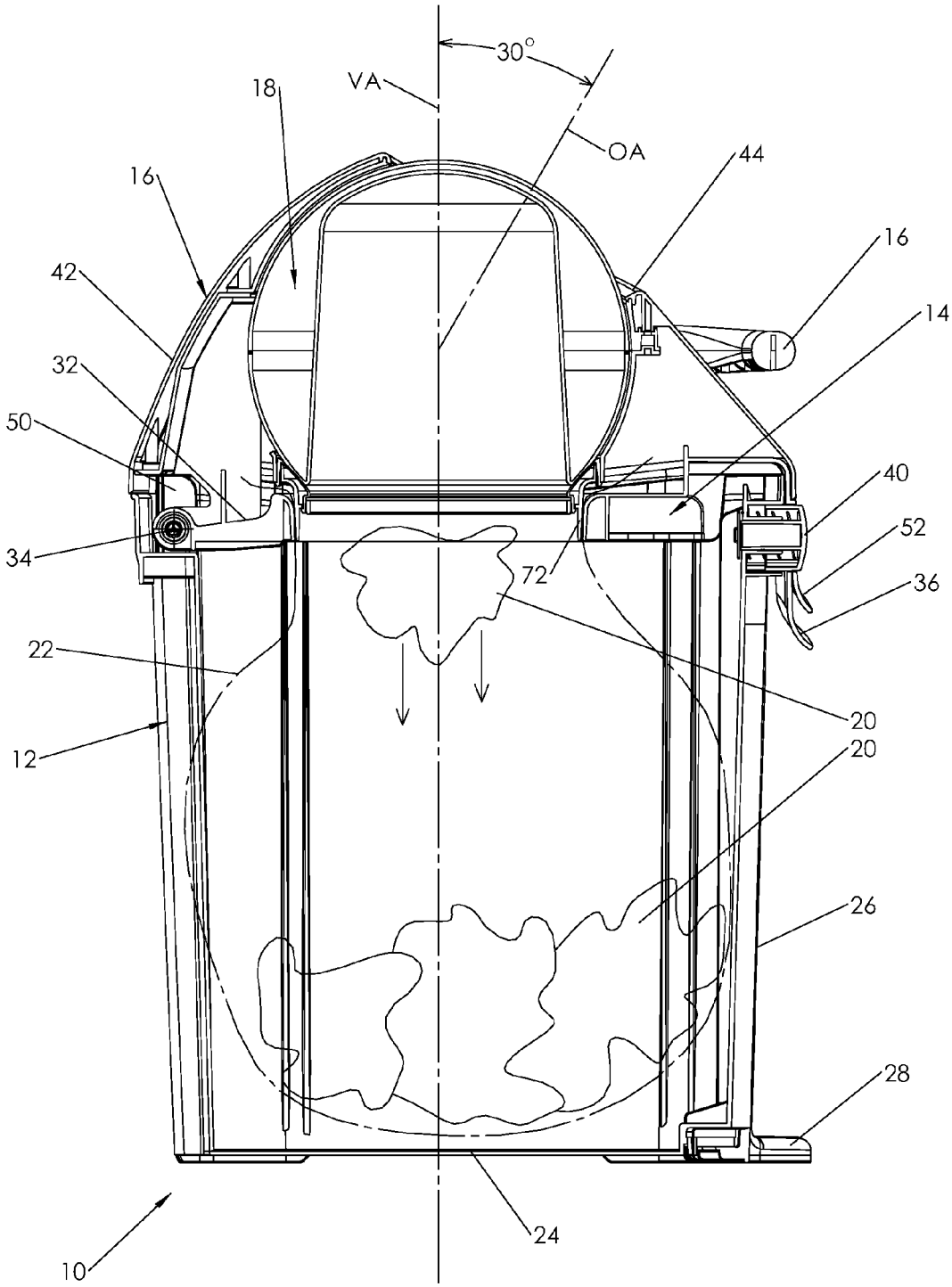
FIG. 12 is a cross-sectional view of the diaper pail of the present invention taken along line 12-12 of FIG. 1.

In a preferred configuration, the upper and lower drum housing portions 58,60 are formed with mating flanges 66,68 so that they can be removably secured together with fasteners and permit the drum 62 to be mounted therein. As shown in FIG. 12, the upper drum housing portion 58 is secured to the underside of the upper wall 42 of the upper enclosure 16, while the lower drum housing portion 60 is in turn secured to the upper drum housing portion 58.

The upper drum housing portion 58 has an upper circular opening 70 aligned along axis AO (FIG. 12) and in communication with the opening 44 in the upper wall 42 of the upper enclosure 16. The lower drum housing portion 60 has a lower circular opening 72 in a lower portion thereof configured and arranged for mated alignment with the central opening 30 in the bagholder frame 14. In this regard, the lower portion 60 includes a downwardly projecting neck 74 surrounding the lower opening 72. As the upper enclosure 16 is rotated to the closed position over the bagholder frame 16, the neck 74 is received into the central opening 30 to capture and hold the disposal bag 22 in place. Briefly referring to FIG. 11, it can be seen that the central opening 30 and neck 74 have complementary tapered surfaces which allow them to firmly capture the bag 22 therebetween and hold the bag in place during use.

Drum 62 is rotatably mounted within the drum housing 56 for rotation about a substantially horizontal axis. The drum 62 is also preferably formed in two mating parts 76,78 each having a substantially spherical outer surface. A cylindrical diaper cavity 80 is located in lower drum half 78 and is arranged along a longitudinal axis perpendicular to the axis of rotation of the drum 62 (see FIG. 6). The drum 62 also includes opposed circular hubs 82,84, which are received and fixed within complementary circular openings 86,88 in the sides of the drum housing portions 58,60. The upper enclosure 16 also includes complementary side openings 90,92 through which the hubs 82,84 are accessible outside of the enclosure 16 (FIG. 1). The drum 62 is rotatably movable within the drum housing 56 between a normally closed position (See FIGS. 1, 4 and 12) wherein the cavity 80 faces downwardly and is aligned with the opening 72 in the lower portion 60 of the drum housing 56 and an open position (See FIG. 2) wherein the cavity 80 faces upwardly and is aligned with the opening 70 in the upper portion 58 of the drum housing 56. In the upper position, a diaper 20 can be deposited into the cavity 80 through the opening 44 in the upper enclosure 16 (See FIG. 2). Upon rotation of the drum 60 to the closed position (FIG. 1 or FIG. 12), the cavity 80 returns to alignment with the lower opening 72, the diaper 20 falls by means of gravity (FIG. 12) through the lower opening 72, through the central opening 30 of the bagholder frame 14 and is deposited into the disposal bag 22.

Now turning to a second aspect of the invention, the drum assembly 18 further includes a flexible plastic annular seal 64 received around the inner peripheral edge of the circular opening 72 in the lower portion 60 of the drum housing 56 (see FIGS. 5, 7-9 and 11). The flexible seal 64 is preferably injection molded from a plastic material having a sufficiently high durometer to provide a low coefficient of friction but yet provide some level of flexibility. The seal 64 preferably includes a vertically extending outer skirt portion 94 anchored within a complementary slot 96 formed in the lower portion 60 of the drum housing 56, and a downwardly angled deck portion 98 having an outer fixed edge 100 connected to an upper edge 102 of the outer skirt portion 94. The deck portion 98 extends radially inwardly and downwardly from the upper edge 102 of the skirt portion 94 terminating in a movable free edge 104, and a skirt 105 depending from the movable free edge 104. The downwardly angled deck portion 98 of the seal 64 engages the outer surface of the drum 62 adjacent the lower opening 72, while the movable free edge 104 of the flexible seal 64 is movable relative to the fixed edge 100 to allow a portion of the deck 98 to conform to irregularities in the outer surface of the drum 62.

Figure 7:
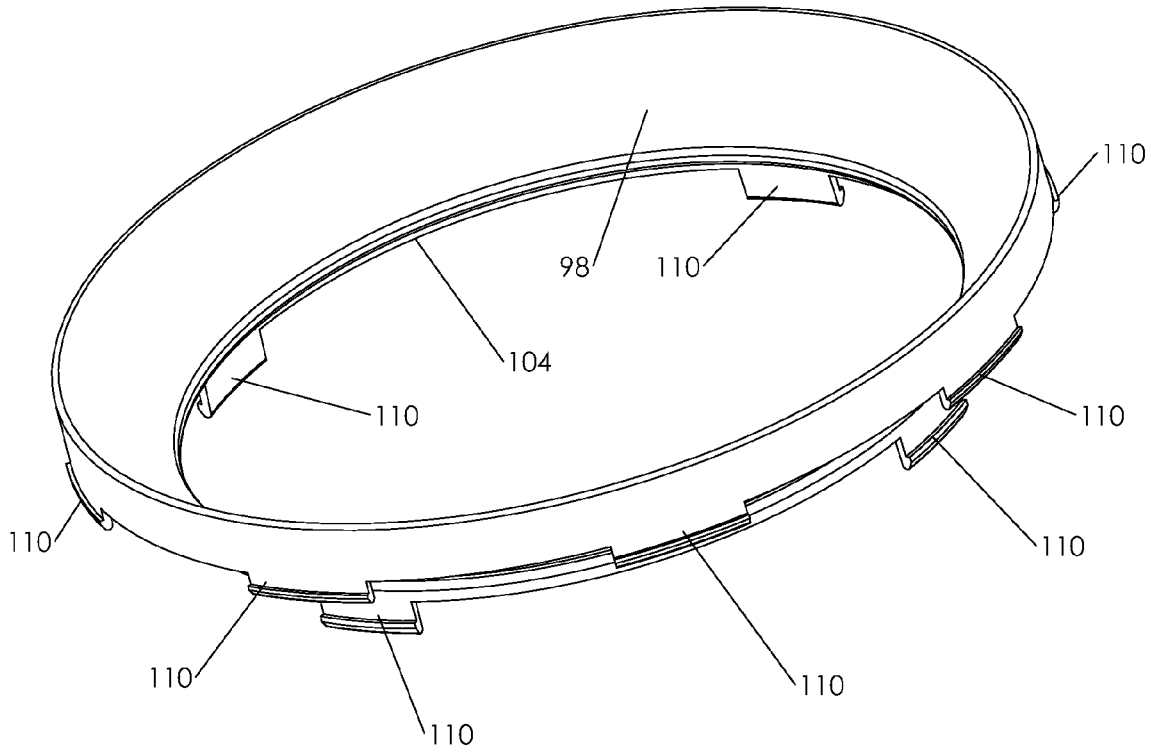
FIG. 7 is a perspective view of the seal of the present invention.
Figure 8:
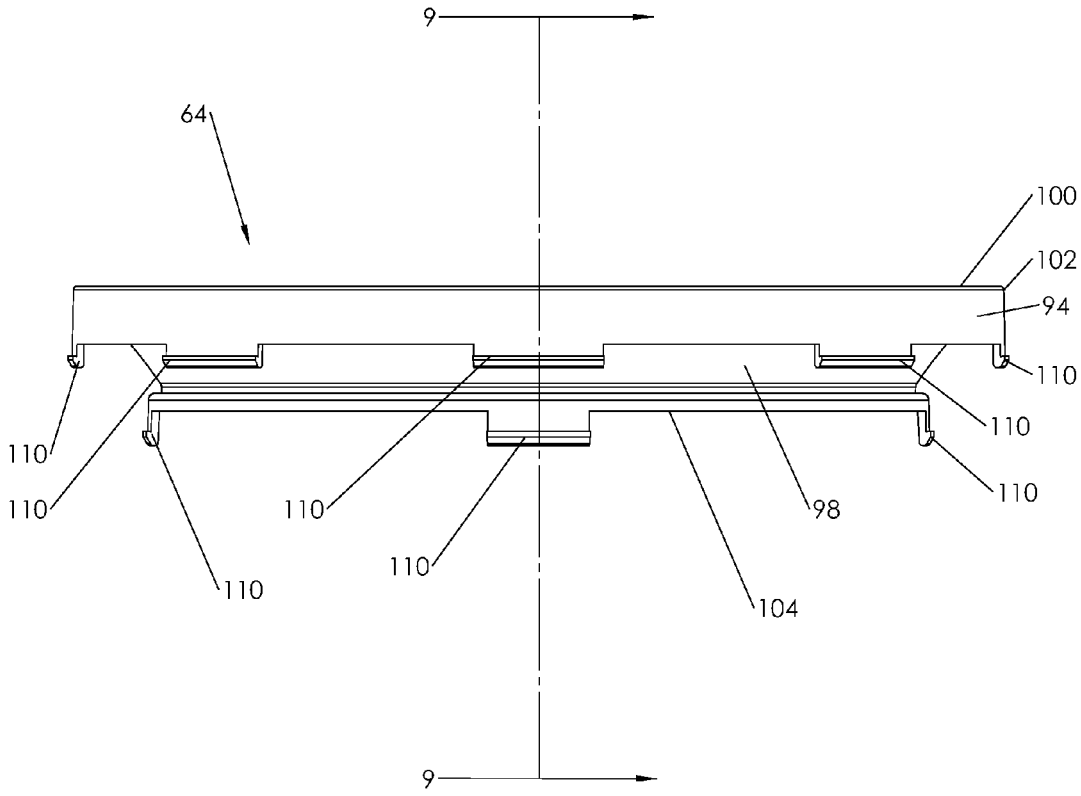
FIG. 8 is a side view of the seal.
Figure 9:
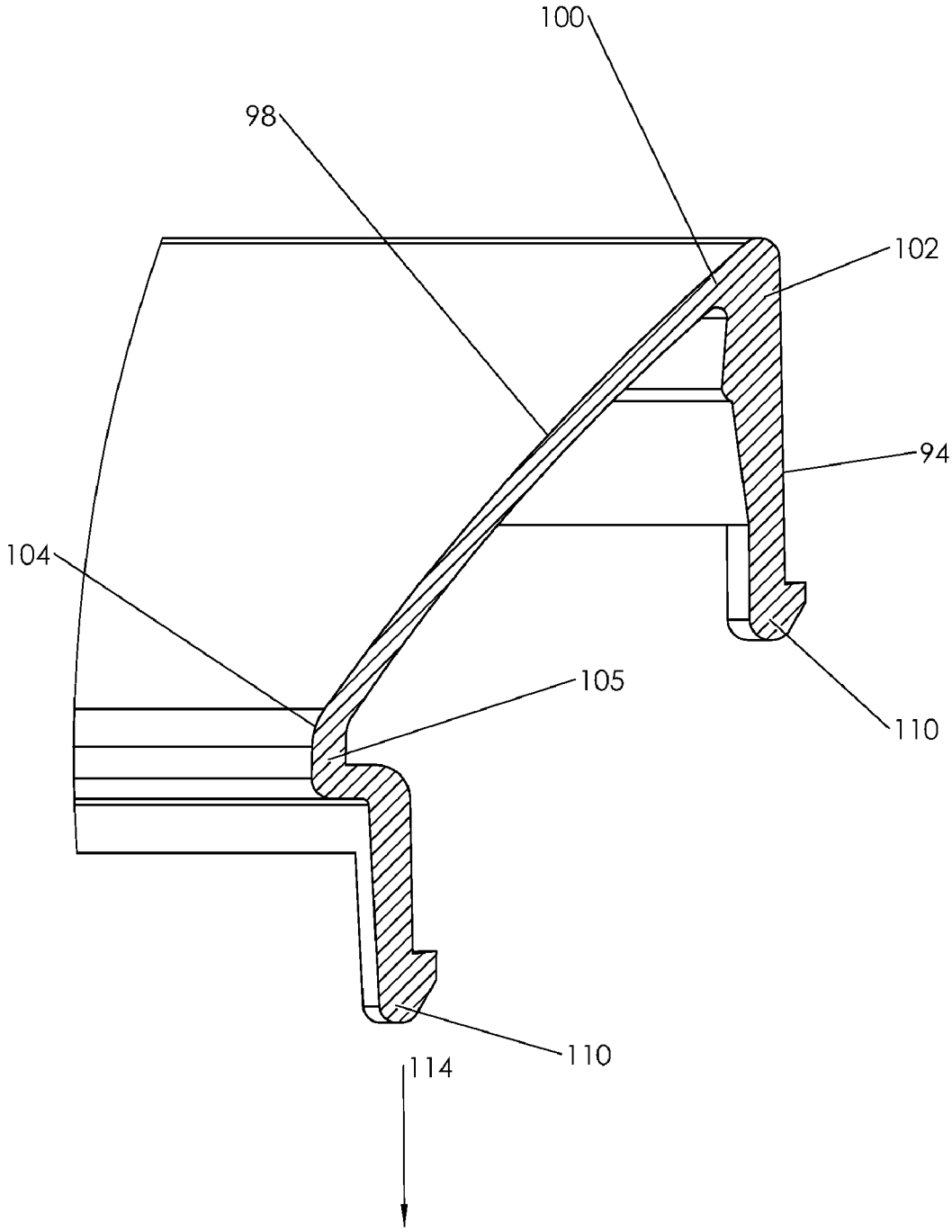
FIG. 9 is a cross-sectional view of the seal taken along line 9-9 of FIG. 8.
Figure 10:
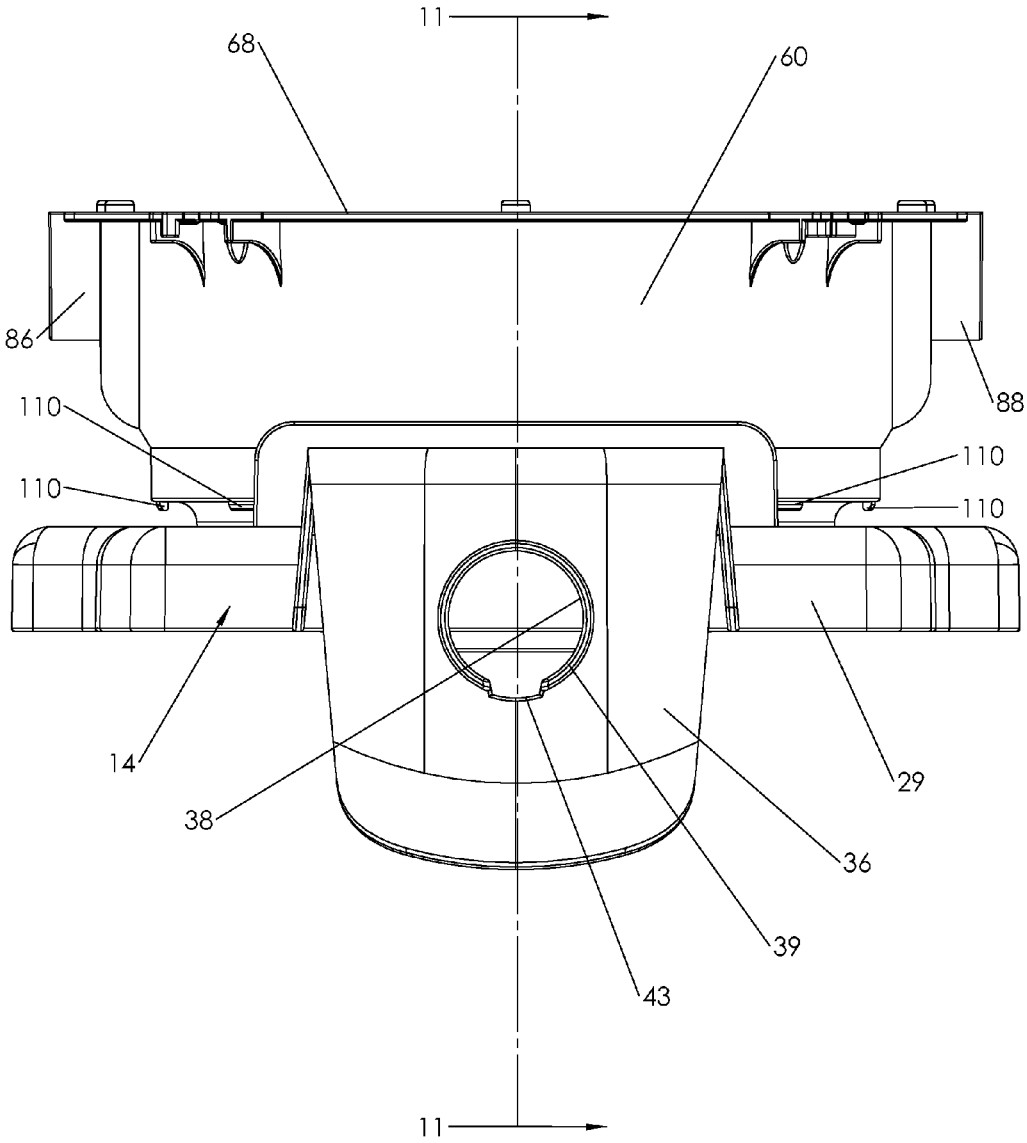
FIG. 10 is a front view of the bagholder frame, lower drum housing and seal in assembled relation.
Figure 11:
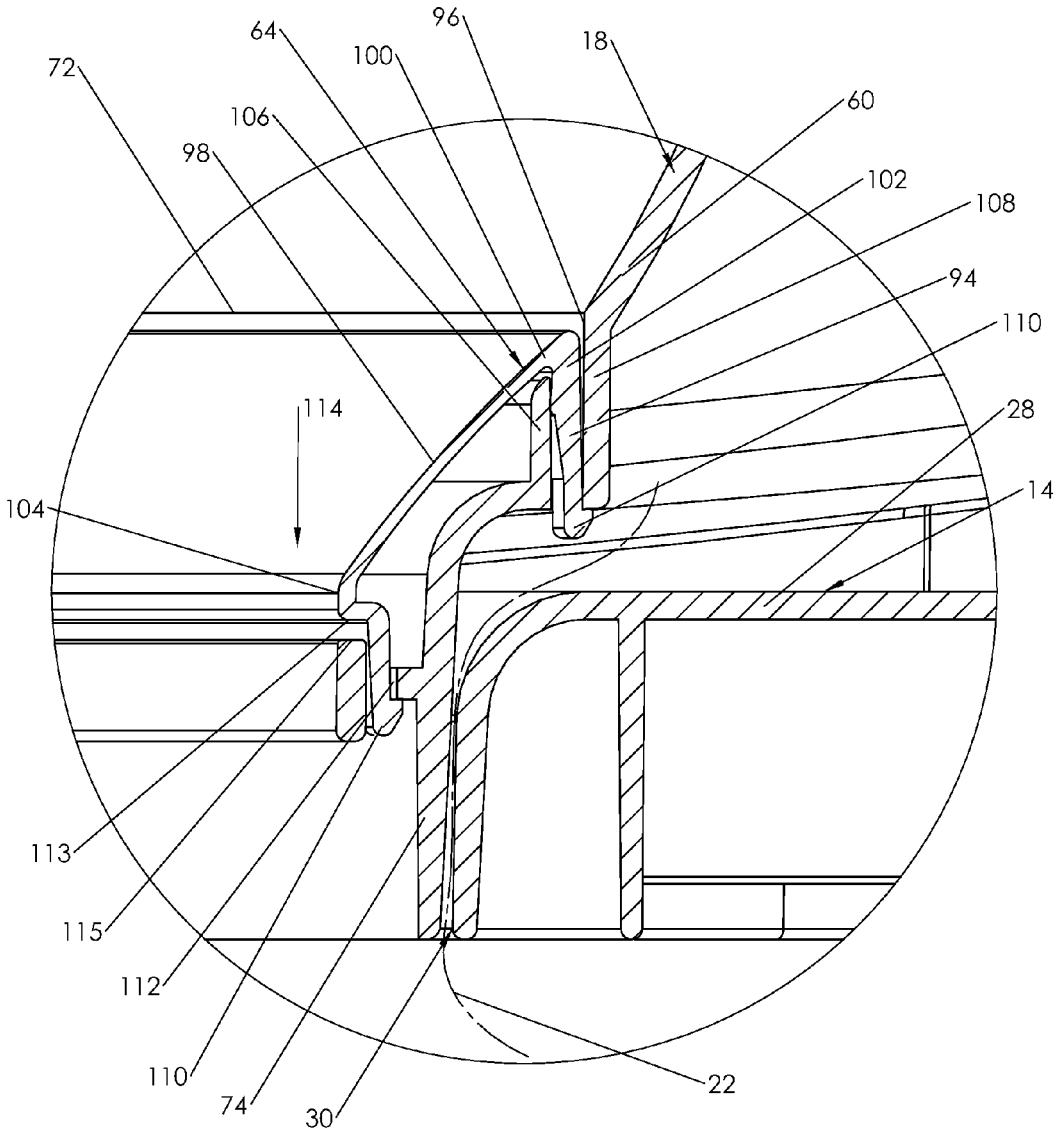
FIG. 11 is a cross-sectional view thereof taken along line 11-11 of FIG. 10.

As best seen in FIG. 7, the outer skirt 94 is fixedly secured within the slot 96 in the lower drum housing 60. The inner and outer walls 106,108 of the slot 96 firmly engage the skirt 94 to hold the skirt 94 in a fixed position. The lower end of the skirt 94 and the lower end of the inner skirt 105 are both provided with snap beads 110 received through openings within the housing 60 to prevent removal of the seal 64 from its position once mounted therein. The upper edge 100 of the deck portion 98 extends from the fixed upper edge 102 of the skirt 94 and is effectively held in a fixed position and provides a smooth transition from the adjacent surface of the lower drum housing 60. However, the movable free edge 104 and skirt 105 of the deck portion 98 are freely movable (cantilevered) from the upper edge 102 of the skirt 94. It can be seen that snap beads 110 on the inner skirt 105 of the deck 98, although received within a slot 112, are not fixedly held in position. There is a landing surface 113 on skirt 105 which is positioned slightly above a riding landing surface 115 on the lower drum housing 60. In this manner, the movable free edge 104 of the deck 98 and skirt 105 are provided with room for downward movement within the slot 112. Arrow 114, as shown in FIGS. 9 and 11 shows the general direction of movement of the deck portion 98 when engaged by the outer surface of the drum 62.

The deck portion 98 of the seal 64 is also provided with a slight upwardly convex curve (See FIGS. 7 and 11) to provide a smooth surface to facilitate the passage of a diaper and a minimal, smooth, and easily conformable surface toward the lower edge of the deck 98 to provide an effective seal with the surface of drum 62. The flexible seal 64 forms a relatively airtight seal around the peripheral edges of the rotating drum 62 to substantially maintain foul air within the disposal bag 22. While a perfect seal will never be possible with rigid surfaces such as found herein, the new configuration as taught herein provides an improved balance between a sufficiently rigid material, which will prevent diaper fasteners from becoming lodged between the drum 62 and the drum housing 56, or damage to the seal 62 from contact with hook and loop fasteners, while providing a low level of friction, and a flexible conforming design, which provides a sufficiently stable and reliable seal.

While the preferred embodiment of the seal 64 is described as being fixed at an outer upper edge 100 thereof, it is contemplated that the seal 64 can also be configured by fixing a movable free edge 104 to the drum housing 60 and allowing the deck portion 98 to extend outwardly and upwardly, having the outer upper edge 100 free to move. This alternate arrangement simply recognizes that it is not critical whether the deck portion 98 is suspended from the outer upper edge or the lower inner edge, but that one edge thereof is fixed and the other is freely movable to conform to the outer surface of the drum 62.

Lastly, an actuator handle 116 actuates movement of the drum 62 between the closed and open positions. The handle 116 includes opposing ends 118,120, which are secured to the opposing hubs 82,84 extending through the upper enclosure 16. To facilitate use of the pail 10, the handle 116 is only movable through 150 degrees of rotation (best shown in FIG. 2). Stop surfaces (not shown) are molded within the openings 90,92 in the upper enclosure 16 to control the extent of rotation of the handle 116.

It can therefore be seen that the instant invention provides an improved diaper pail including an improved flexible plastic seal that reduces escaping odors. The plastic seal reduces occurrences of diapers becoming lodged between the drum and the housing and damage to the seal from contact with hook and loop fasteners, while also providing a low coefficient of friction for ease of rotation of the drum. The diaper pail is simple in construction, low in cost and can be molded using conventional injection molding techniques. Additionally, the diaper pail 10 provides an enclosure with a minimum of holes and gaps so as to minimize the escape of odors, a smooth and continuous easily inspected and cleaned top surface adjacent the point where the soiled diapers are inserted, and a receptacle assembly which is free of doors, protruding rotating drums, and similar mechanical looking components which would make the diaper pail 10 look too mechanical and this less suitable for use in a child's nursery. Furthermore, the diaper pail is aesthetically attractive to the eye, has an opening angled toward the front to facilitate placement of the diaper into the drum and includes a handle, which does not require a full 180 degree rotation to move the drum between the operable positions. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A diaper pail comprising:

a pail having a closed bottom and upwardly extending sidewalls;

an upper enclosure configured and arranged to be received over an open top of said pail, said upper enclosure having an upper wall, said upper wall having an opening sized to allow a diaper to pass through, said opening in said upper wall of said upper enclosure being aligned on an axis that is angled relative to a vertical axis passing through said pail;

a drum assembly within said upper enclosure, said drum assembly including a drum housing having a spherical inner surface and an opening in an upper portion thereof in communication with said opening in said upper wall of said upper enclosure, and a circular opening in a lower portion thereof, said openings in said upper and lower portions being sized to allow a diaper to pass through, said drum assembly further including a drum rotatably mounted within said drum housing for rotation about a substantially horizontal axis, said drum having spherical outer surface and a cavity extending inwardly from said spherical outer surface, said cavity having a longitudinal axis perpendicular to the axis of rotation of the drum, said cavity being sized to receive a diaper, said spherical outer surface of said drum being configured and arranged for closely spaced sliding relation with said spherical inner surface of said drum housing;

said drum being rotatably movable within said drum housing between a closed position wherein said cavity is aligned with said opening in said lower portion of said drum housing and an open position wherein said cavity is aligned with said opening in said upper portion of said drum housing;

a circular flexible seal configured and arranged to be received around a peripheral edge of said circular opening in said lower portion of said drum housing, said flexible seal including a skirt portion anchored to said lower portion of said drum housing and an annular deck portion having a fixed edge connected to an edge of said skirt portion, said deck portion extending inwardly and downwardly from said edge of said skirt portion and terminating in a movable free edge, said deck portion having an upwardly convex curvature between said fixed edge and said movable free edge, said upwardly convex deck portion of said flexible seal engaging with said spherical outer surface of said drum, said movable free edge of said flexible seal being movable relative to the fixed edge such that said upwardly convex deck portion may conform to irregularities in said outer surface of said drum; and an actuator handle connected to said drum to actuate movement of said drum between said closed and open positions.

2. The diaper pail of claim 1 wherein said axis of said opening is angled about 30 degrees relative to said vertical axis.

3. The diaper pail of claim 1 wherein said actuator handle is movable through an arc of about 150 degrees.

4. The diaper pail of claim 1 further comprising a bagholder frame configured and arranged to be received over an open top of said pail, said bagholder frame having an opening sized to allow a diaper to pass through, said lower portion of said drum housing including a downwardly projecting neck around said opening which is received in interfitting mating relation with the opening in the bagholder frame.

* * * * *